US011142980B2

(12) United States Patent
Wheater et al.

(10) Patent No.: US 11,142,980 B2
(45) Date of Patent: Oct. 12, 2021

(54) ARTICULATED WIRELINE HOLE FINDER

(71) Applicants: Guy Wheater, Scarborough (GB); Stuart Huyton, Morayshire (GB)

(72) Inventors: Guy Wheater, Scarborough (GB); Stuart Huyton, Morayshire (GB)

( * ) Notice: Subject to any disclaimer, the term of this patent is extended or adjusted under 35 U.S.C. 154(b) by 0 days.

(21) Appl. No.: 16/806,815

(22) Filed: Mar. 2, 2020

(65) Prior Publication Data

US 2020/0248515 A1 Aug. 6, 2020

Related U.S. Application Data

(63) Continuation of application No. 15/914,827, filed on Mar. 7, 2018, now Pat. No. 10,612,330, which is a continuation of application No. 14/981,394, filed on Dec. 28, 2015, now Pat. No. 9,945,196, which is a continuation of application No. 13/780,917, filed on Feb. 28, 2013, now Pat. No. 9,249,641.

(51) Int. Cl.

| | |
|---|---|
| ***E21B 23/12*** | (2006.01) |
| ***E21B 23/14*** | (2006.01) |
| ***E21B 17/10*** | (2006.01) |

(52) U.S. Cl.

CPC ..... *E21B 23/12* (2020.05); *E21B 17/1078* (2013.01); *E21B 23/14* (2013.01)

(58) Field of Classification Search

CPC ..... E21B 23/002; E21B 17/1078; E21B 23/14
See application file for complete search history.

(56) References Cited

U.S. PATENT DOCUMENTS

| | | | | |
|---|---|---|---|---|
| 4,192,380 | A | 3/1980 | Smith | |
| 5,415,238 | A | 5/1995 | Nice | |
| 6,283,205 | B1 | 9/2001 | Cannon | |
| 9,249,641 | B2 | 2/2016 | Wheater et al. | |
| 9,512,713 | B2 | 12/2016 | Ahmed et al. | |
| 2008/0135293 | A1* | 6/2008 | Tashiro | E21B 23/14 175/45 |

(Continued)

FOREIGN PATENT DOCUMENTS

| | | |
|---|---|---|
| EP | 0212456 | 3/1987 |
| WO | 2004/061349 | 7/2014 |

OTHER PUBLICATIONS

USPTO Office Action for U.S. Appl. No. 13/780,917 dated Apr. 29, 2015.

(Continued)

*Primary Examiner* — Brad Harcourt
(74) *Attorney, Agent, or Firm* — Tumey L.L.P.

(57) ABSTRACT

The articulated wireline hole finder is a modular device which attaches to the bottom of a wireline logging tool-string to aid conveyance down irregular shaped and/or deviated boreholes which possess features such as ledges, washouts, and contractions, that might otherwise terminate full descent of the tool-string to the bottom of the borehole and thereby compromise the wireline data acquisition objectives. Elements of the articulated wireline hole finder may include a low friction roller nose assembly and spacer sub, an articulated spring joint, that transfers tool-string weight and directs lateral movement of the roller nose towards hole center, and a pair of five arm centralizers that possess a wide dynamic range.

19 Claims, 13 Drawing Sheets

(56) References Cited

U.S. PATENT DOCUMENTS

2009/0145596 A1* 6/2009 Hansen ..... E21B 23/14
166/117.5
2012/0061098 A1* 3/2012 Hall ..... E21B 17/1057
166/381

OTHER PUBLICATIONS

USPTO Notice of Allowance for U.S. Appl. No. 13/780,917 dated Sep. 28, 2015.
USPTO Issue Notification for U.S. Appl. No. 13/780,917 dated Jan. 13, 2016.
GB Search and Examination Report for GB Application No. GB1014351.9 dated Feb. 24, 2011.
USPTO Office Action for U.S. Appl. No. 14/981,394 dated Jul. 24, 2017.
USPTO Notice of Allowance for U.S. Appl. No. 14/981,394 dated Dec. 12, 2017.
USPTO Issue Notification for U.S. Appl. No. 14/981,394 dated Mar. 28, 2018.
USPTO Office Action for U.S. Appl. No. 15/914,827 dated Jul. 15, 2019.
USPTO Notice of Allowance for U.S. Appl. No. 15/914,827 dated Nov. 25, 2019.
USPTO Issue Notification for U.S. Appl. No. 15/914,827 dated Mar. 18, 2020.

* cited by examiner

ARTICULATED WIRELINE HOLE FINDER

CROSS-REFERENCE TO RELATED APPLICATIONS

This application is a continuation of application Ser. No. 15/914,827 filed Mar. 7, 2018 which is a continuation of U.S. application Ser. No. 14/981,394, entitled "Articulated Wireline Hole Finder," filed Dec. 28, 2015, which is a continuation of U.S. application Ser. No. 13/780,917, now U.S. Pat. No. 9,249,641 which issued on Feb. 2, 2016, entitled "Articulated Wireline Hole Finder," and filed on Feb. 28, 2013, the entire of each disclosure is incorporated herein by reference in their entirety.

BACKGROUND OF THE INVENTION

Field of the Invention

The present invention relates to wireline logging and, more particularly, in one or more embodiments, the present invention relates to a device for improving the conveyance of wireline logging tools down irregular and/or deviated boreholes.

Background of the Invention

Wireline logging is a common operation in the oil industry whereby down-hole electrical tools are conveyed on wireline (also known as "e-line" in industry parlance) to evaluate formation lithologies and fluid types in a variety of boreholes. In irregular shaped boreholes, characterized by variations in hole size with depth, and/or in deviated boreholes, there can be problems in conveying wireline logging tools to total well depth since the bottom of the tool-string may impact upon certain features in the borehole, such as ledges, washouts, or contractions. In this situation full data acquisition from total well depth may not be possible and remedial action may be required, either altering the borehole conditions for more favorable descent or improving the tool-string geometry to navigate past the obstructions; either way may be costly to the well operator.

Consequently, there is a need for improving wireline tool-string geometry to aid conveyance past ledges, washouts, and contractions which may be present in irregular shaped and/or deviated boreholes.

BRIEF SUMMARY OF SOME OF THE PREFERRED EMBODIMENTS

These and other needs in the art are addressed in one embodiment by an articulated wireline hole finder. The articulated wireline hole finder may comprise a modular device. The articulated wireline hole finder may comprise a roller nose; the roller nose may comprise a central mandrel and wheel assemblies. The articulated wireline hole finder may additionally comprise a main body, a spacer sub, and an articulated spring joint. The articulated wireline hole finder may attach to the bottom of a wireline logging tool-string to aid conveyance down irregular shaped and/or deviated boreholes. These irregular shaped and/or deviated boreholes may possess features such as ledges, washouts, and contractions; features which may potentially terminate full descent of the tool-string to the bottom of the borehole.

These and other needs in the art may be addressed by an embodiment of an articulated wireline hole finder, comprising: a main body, wherein the main body is a tube; a spacer sub, wherein the spacer sub is a tube; an articulated spring joint, wherein the articulated spring joint connects to both the main body and the spacer sub; a low-friction roller nose, wherein the low-friction roller nose is connected to the spacer sub; and wherein the articulated wireline hole finder is capable of attachment to a wireline logging tool-string.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which:

FIG. 3(*a*) illustrates an embodiment of a close-up view of the articulated wireline hole upon impacting a ledge, and the forces applied to the spring joint and the roller nose from the buoyant tool-string weight;

FIG. 3(*b*) illustrates an embodiment of a close-up view of the articulated wireline hole after full actuation of the spring joint, allowing lateral and downwards movement of the roller nose to hole center;

FIG. 3(*c*) illustrates an embodiment of a close-up view of the articulated wireline hole upon successful navigation past the ledge, whereby the spring joint has snapped back into its default locked position;

FIG. 7(*a*) illustrates an embodiment of a section view through the roller nose assembly, showing the layout of the wheels and wheel retainers, and the method of fixing to the roller nose mandrel;

FIG. 9(*a*) illustrates an embodiment of a section view of the articulated spring joint showing internal components;

FIG. 12(*a*) illustrates an embodiment of a close-up view of one end of the centralizer which illustrates the leaf spring arms and rivets, pivoting connections to the sliding end mounts, and locking pins;

DETAILED DESCRIPTION OF THE PREFERRED EMBODIMENTS

In an embodiment the wireline tool-string geometry is improved to aid conveyance past ledges, washouts, and contractions which may be present in irregular shaped and/or deviated boreholes. The term "hole finder" is commonly used in the wireline industry for a device that connects below a logging tool-string to aid conveyance. Without limitation, articulated is an improvement since the device possesses a pivoting component which enhances performance in large ledges, washouts, or contractions that may be present in the borehole.

The articulated wireline hole finder is modular in design and features key innovations over existing hole finders, which are often a re-arrangement of existing logging tools and/or accessories that happen to be available at the well site at the time of the borehole survey, i.e. they are not custom built for the purpose of effective conveyance in irregular shaped and/or deviated boreholes.

Figure 1:
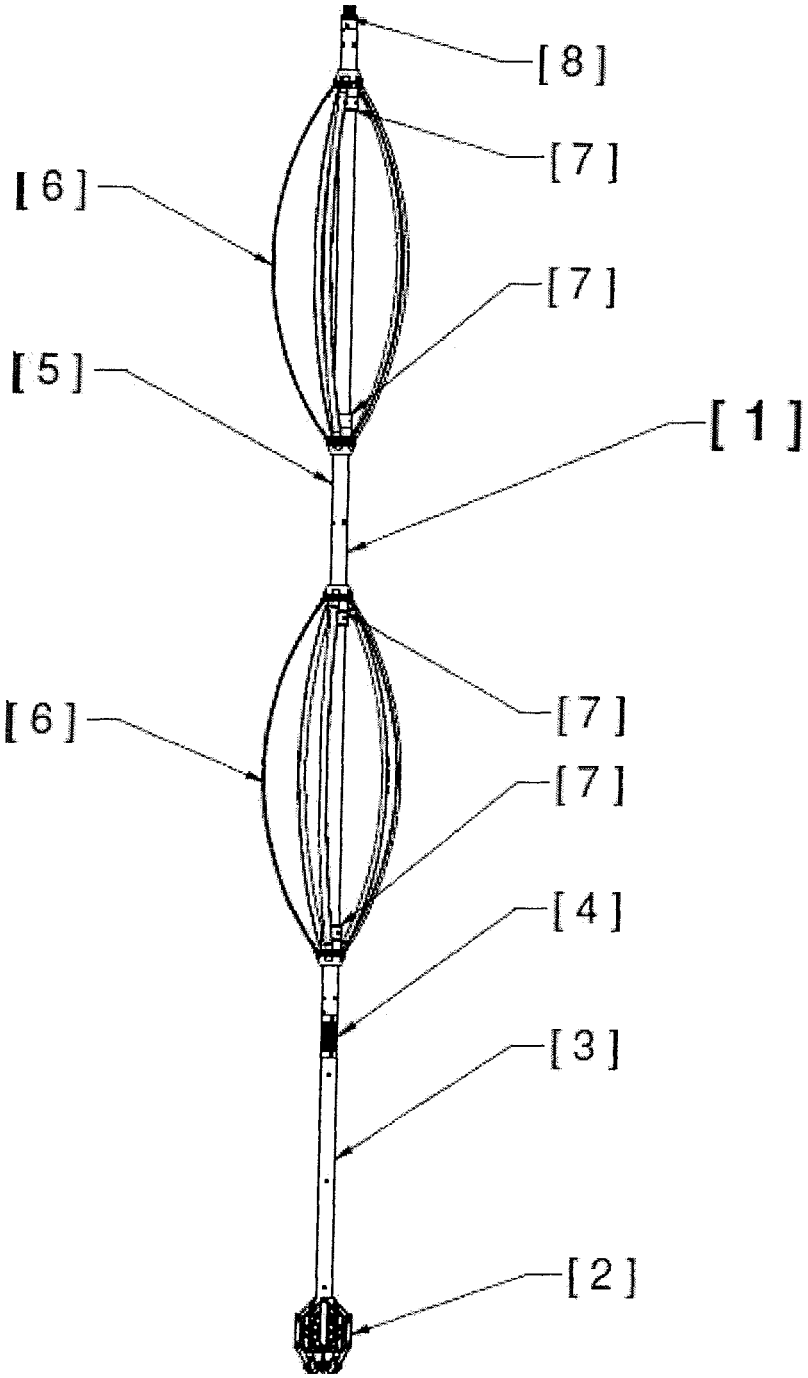
FIG. 1 illustrates an embodiment of an articulated wireline hole finder.

FIG. 1 illustrates an articulated wireline hole finder [1] in accordance with one embodiment. This embodiment of the articulated wireline hole finder comprises a series of modular components connected together via stub acme threads, which are commonly used in oilfield down-hole equipment. At the bottom of the articulated wireline hole finder is a roller nose [2] which comprises five sets of wheeled assemblies, each assembly holding three independent wheels. The wheeled assemblies are radially phased at approximately and about seventy-two degrees around the central axis of the roller nose mandrel, facilitating low friction movement down and across the borehole. Additionally, in deviated boreholes there may be solids and/or debris accumulated on the low side of the hole which the roller nose [2] may need to drive through in order to continue descent of the well. The roller nose may be selected in accordance with the size of the borehole being logged. For illustration purposes only, FIG. 1 shows an embodiment of the roller nose [2] with an external diameter of about 9¾ inches, used for a 12¼ inch borehole, which is a common hole size in the oil industry.

Figure 3:
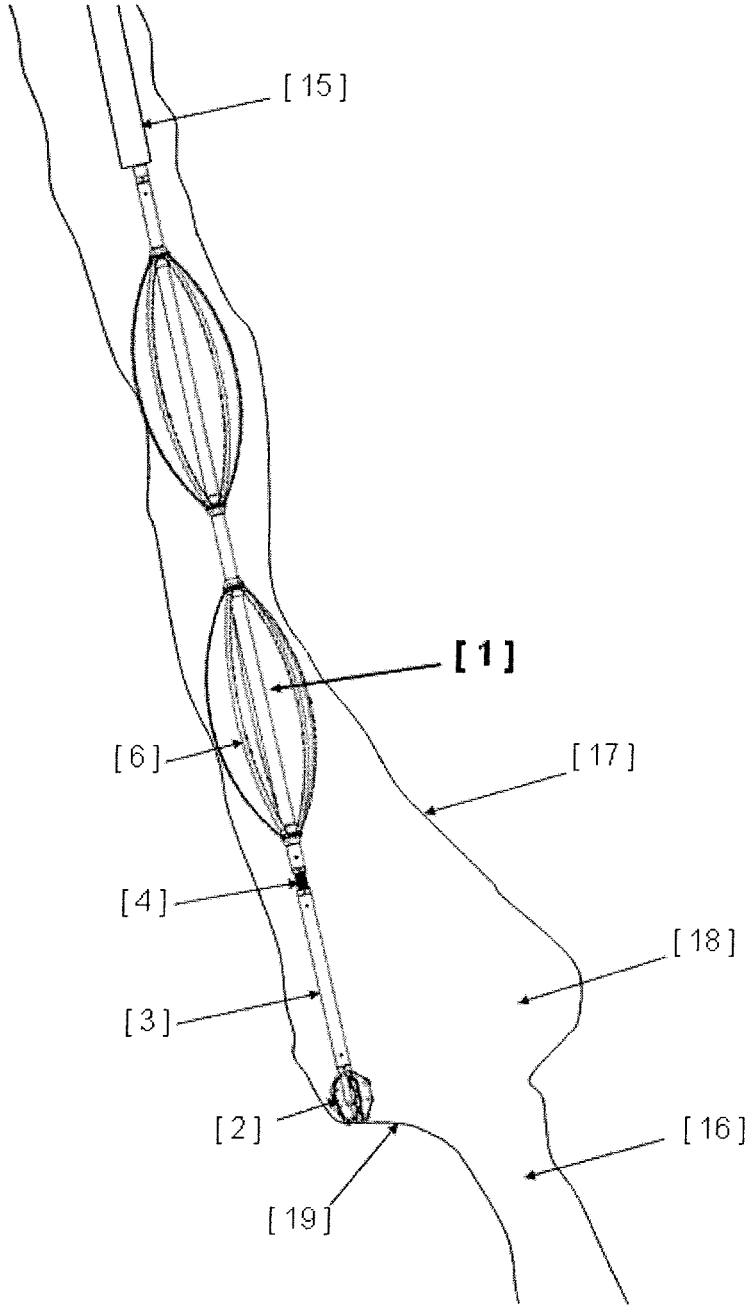
FIG. 3 illustrates an embodiment for an articulated wireline hole finder in relation to features that may be found in irregular shaped and/or deviated boreholes, such as ledges, washouts, and contractions.
Figure 3A:
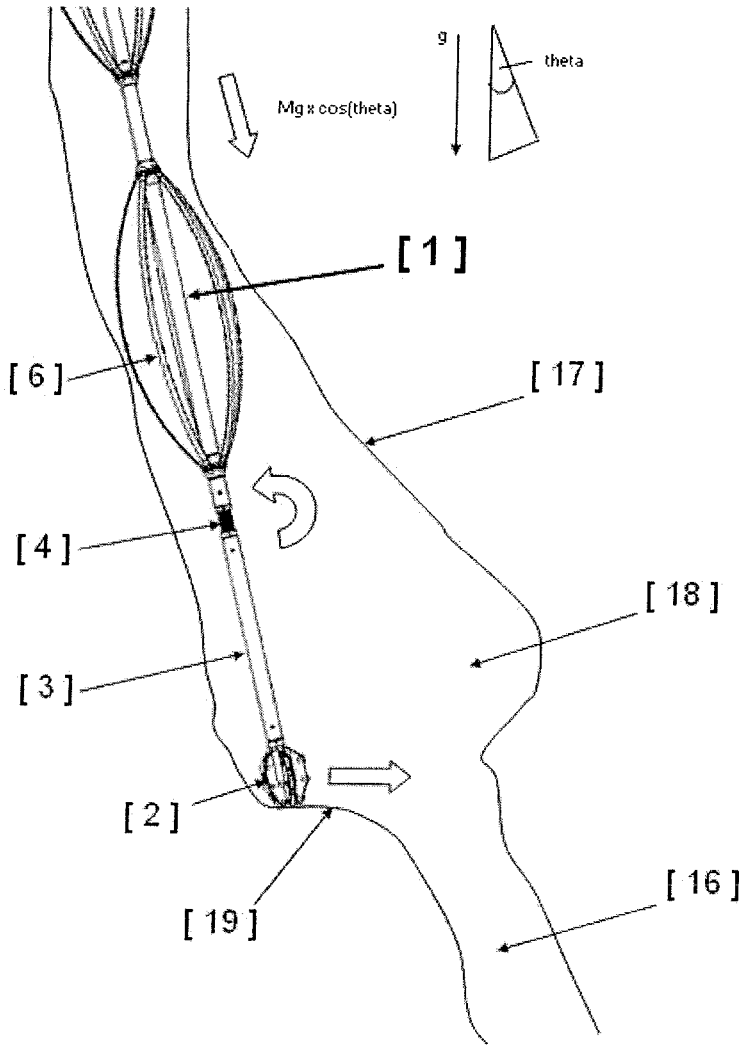
Figure 3B:
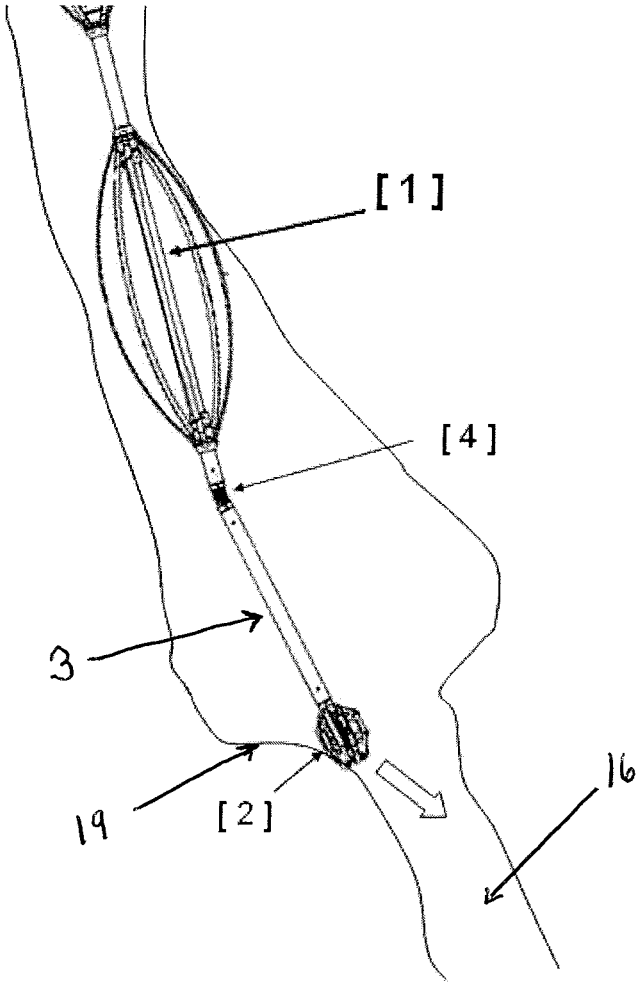
Figure 3C:
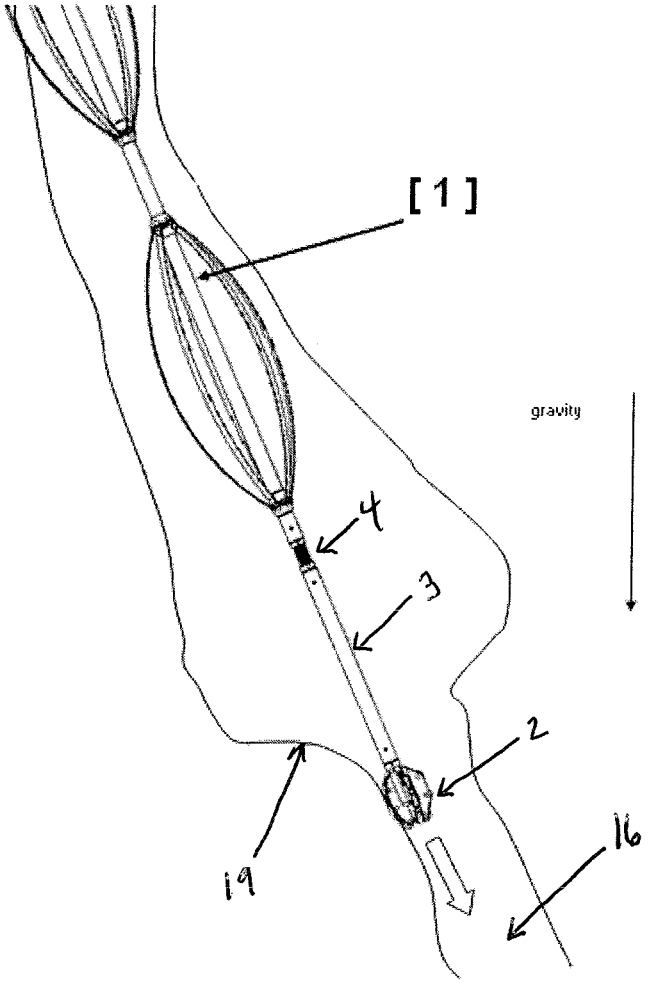

Above the roller nose [2] is a spacer sub [3] (open to wellbore fluid) which is a tube, for example of about seventy-three millimeters in diameter and of a length of about one meter to about three meters. Depending on the size and condition of the borehole, larger washouts may require a longer spacer sub [3]. The upper end of the spacer sub [3] is connected to an articulated spring joint [4]. The articulated spring joint [4] allows the roller nose [2] and spacer sub [3] to be decoupled from the rest of the articulated wireline hole finder [1] when activated, with approximately about twelve degrees movement, in any direction, from the central axis of the articulated wireline hole finder [1]. The articulated spring joint [4] is activated when force from above, or applied tool weight, exceeds the rating of the spring in the joint. The articulated spring joint [4] is actuated when the roller nose [2] impacts an obstruction in the borehole, transferring buoyant tool-string weight from above and compressing the spring in the joint. When the spring is compressed the roller nose [2] and spacer sub [3] may then pivot in the joint by up to about twelve degrees, pushing the roller nose [2] across and down the borehole, past the debris or obstruction(s). To be more specific, if the roller nose [2] impacts upon a feature in the borehole, such as a ledge or contraction (as illustrated in FIG. 3), it may naturally track to hole center, called: "finding hole," or it may momentarily come to rest if the ledge or contraction is significant. If the roller nose comes to rest, the combined buoyant weight of the wireline tool-string and main body [5] of the articulated wireline hole finder [1] may be applied onto the articulated spring joint [4], compressing the spring and initiating a pivoting action. When the articulated spring joint [4] is activated the roller nose [2] experiences a horizontal component of lateral force and it moves in the direction of that force, passing the obstruction, and tracking towards hole center. Upon finding the hole center, the roller nose [2] is once again suspended in the borehole, without any tool weight being applied from above, and the articulated spring joint returns to its default condition of locked straight for continued descent down the borehole. The maximum lateral movement the roller nose [2] can make, when the articulated spring joint [4] is activated, is governed by the length of the spacer sub [3] according to the following equation:

$$\text{Roller nose lateral limit (in.)}=[\text{Spacer } \textit{Sub} \text{ Length (in.)}]\times[\sin(12°)].$$

Above the articulated spring joint [4] is the main body [5] (open to wellbore fluid) which, for example, is a tube about seventy-three millimeters in diameter and approximately about six meters long. Mounted on the main body [5] are two centralizers [6] of maximum expanded diameter of about thirty inches, and four centralizer lock rings [7] which limit the axial movement of the centralizers on the main body [5] but maintain rotational freedom of the centralizers [6] around the main body [5]. Each centralizer [6] has five arms. The centralizers [6] have a large dynamic range, effective in borehole sizes from less than about six inches to greater than about twenty inches. Since the centralizers [6] are free to rotate on the main body [5], any tool-string rotation induced by wireline cable torque will not be applied to the centralizers [6]. The centralizer lock rings [7] are held by radial grub screws in the main body [5]. Each centralizer [6] may have two associated centralizer lock rings [7]. At the top of the articulated wireline hole finder [1] is the threaded crossover [8] to the wireline logging tool-string. The threaded crossover [8], is a simple threaded connection, customized to the logging vendors' wireline tool-string connection. It is important to note that under normal running conditions, where no borehole obstructions are encountered, the articulated wireline hole finder [1] is stiff, i.e. there is no articulation in the spring joint [4] unless the roller nose [2] becomes immobile and then a force is applied from above.

Figure 2:
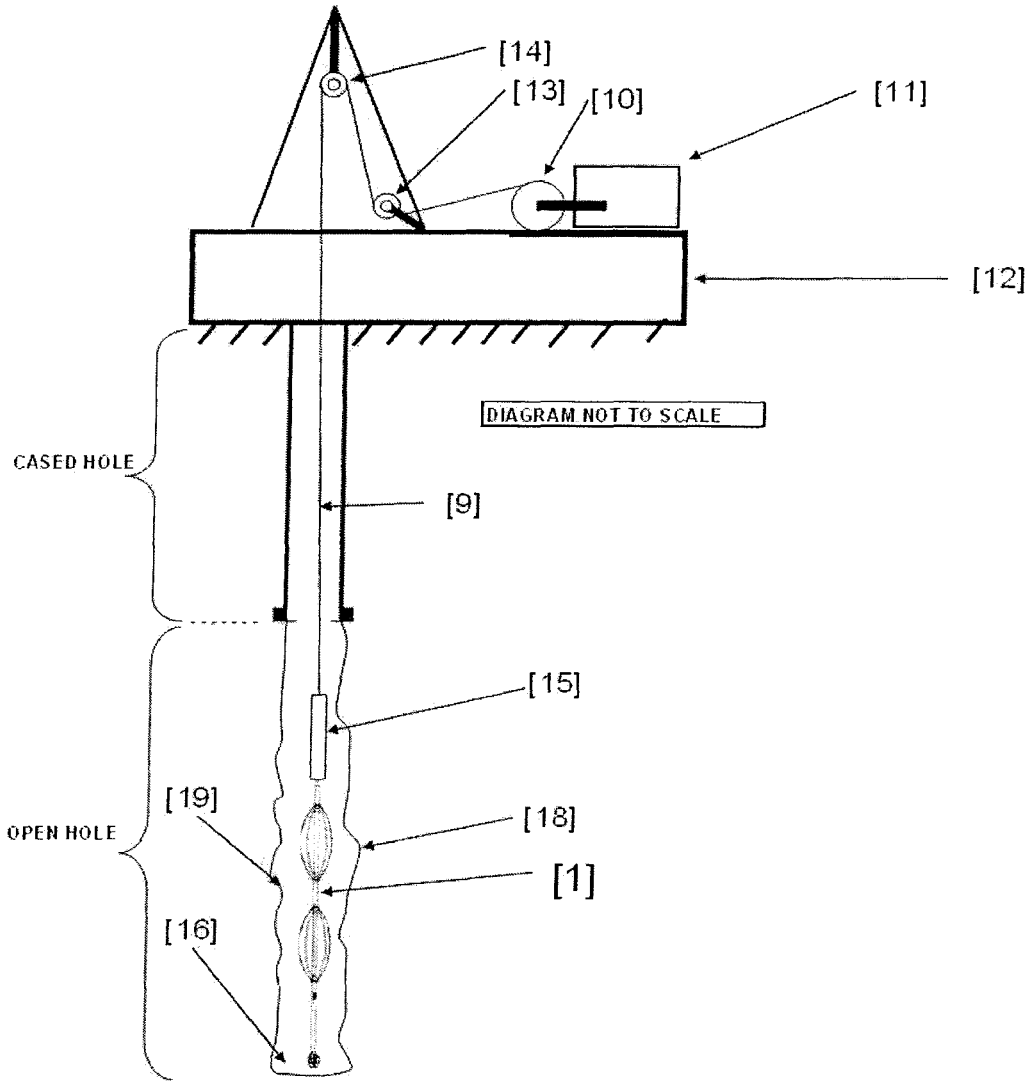
FIG. 2 illustrates an embodiment for an articulated wireline hole finder in relation to the drilling rig, logging tools, and borehole.

FIG. 2 illustrates a generic logging operation with a demonstration of one embodiment of the articulated wireline hole finder [1] deployed below the wireline logging tool-string [15] in a borehole [16]. The drilling rig, ship, or platform [12] is located above the borehole [16] and has a wireline logging unit [11], containing data acquisition equipment and associated devices mounted securely to the drilling structure. Wireline cable [9] is spooled off the drum [10] around the lower sheave [13] and upper sheave [14] into the borehole [16]. At the end of the wireline logging cable [1] is a tool-string [15] which is used to acquire petro-physical data or samples from the borehole. Below the wireline tool-string [15] is the articulated wireline hole finder [1] which aids conveyance of the tool-string [15] past features in the borehole [16] which might otherwise prohibit full descent to the bottom of the well. These features may include, but are not restricted to, borehole washouts [18] created by borehole instabilities during the drilling process, or ledges and contractions [19], which are potential obstacles to tool-string descent.

FIG. 3 illustrates an embodiment of the articulated wireline hole finder [1] when it impacts a ledge [19] in a slightly deviated borehole [16]. The centralizers [6] help maintain the position of the articulated wireline hole finder [1] towards the center of the borehole [16], but in this case the ledge is of a scale and geometry where the roller nose [2] has no choice but to impact upon the ledge [19]. Also illustrated are the borehole wall [17], a washout [18], and the spacer sub [3], articulated spring joint [4], and wireline logging tool-string [15].

FIG. 3(*a*) illustrates an embodiment of the lower part of the articulated wireline hole finder [1] when it impacts a ledge [19] in a slightly deviated borehole [16], the borehole angle from vertical is shown as theta. As the roller nose [2] comes into contact with the ledge the tool-string weight from above (where "weight from above" is represented by the formula: Mass×the acceleration of gravity×cosine (theta); and illustrated in shorthand on FIG. 3(*a*) as: Mg×cos (theta)) may be transferred down to the spring joint [4], controlled by the wireline winch operator at surface, as illustrated in FIG. 2. The applied force compresses the spring and allows a pivoting action around the articulated spring joint [4] and lateral movement of the roller nose [2] and spacer sub [3] towards the middle of the borehole [16].

FIG. 3(*b*) illustrates an embodiment of the lower part of the articulated wireline hole finder [1] on a ledge [19] in a slightly deviated borehole [16], after it has been activated, i.e. the roller nose [2] and spacer sub [3] have rotated up to an angle of about 12 degrees from the central axis of the articulated wireline hole finder [1], allowing lateral movement towards and down the center of the hole.

FIG. 3(*c*) illustrates a close-up view of the lower section of the articulated wireline hole finder [1] after it has passed a ledge [19] in a slightly deviated borehole [16]. After the roller nose has dropped past the ledge [19] its weight, plus the weight of the spacer sub [3], plus the spring force, thrusts the articulated spring joint [4] to its default locked position, stiff and straight, where no articulation is allowed.

Figure 4:
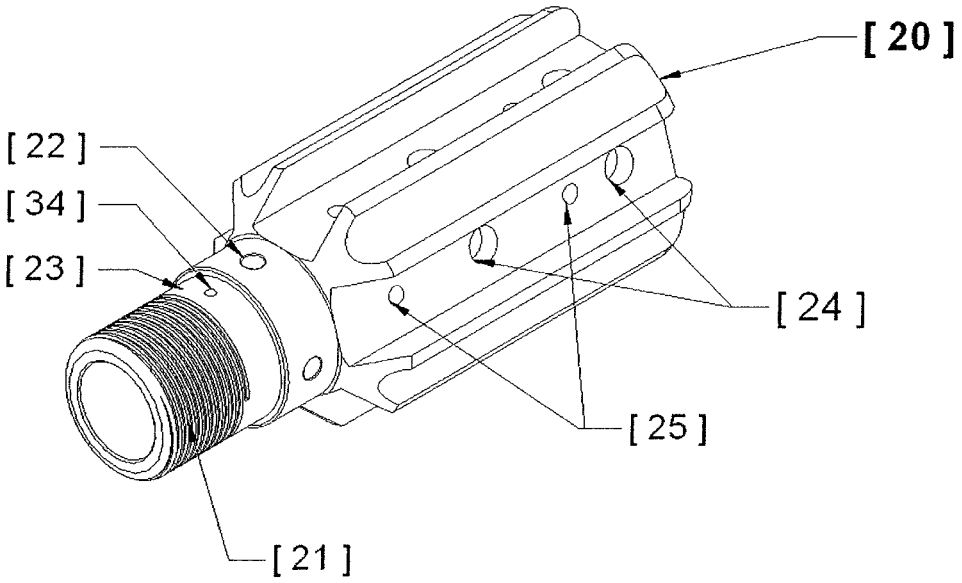
FIG. 4 illustrates an embodiment of an isometric view of the roller nose mandrel upon which the wheel sub-assemblies are radially mounted.

FIG. 4 illustrates an isometric view of an embodiment of the roller nose mandrel [20] with five longitudinal slots phased at approximately and about seventy-two degrees to hold the five wheeled sub-assemblies, which are positively secured with metric cap head bolts and large dowel pins. The female threads [25] and the holes for the dowel pins [24] are clearly illustrated. A stub acme male thread [21] allows the mandrel [20] to be fixed to the spacer sub [3] located above it (as illustrated in FIG. 1), and a threaded pilot hole [34] is for the button socket head screw (not shown) which stops the roller nose [2] from unscrewing from the spacer sub [3], as illustrated in FIG. 1. A machined flange [23] ensures a good fit between the spacer sub [3] and the roller nose mandrel body [20], as shown in FIG. 1. Four opposing holes in the mandrel body [22] allow the fitment of a 'C' Spanner (not shown) for tightening the roller nose mandrel [20] into the spacer sub [3]. To save weight the mandrel is bored out from the inside, which is illustrated in FIG. 7*b*.

Figure 5:
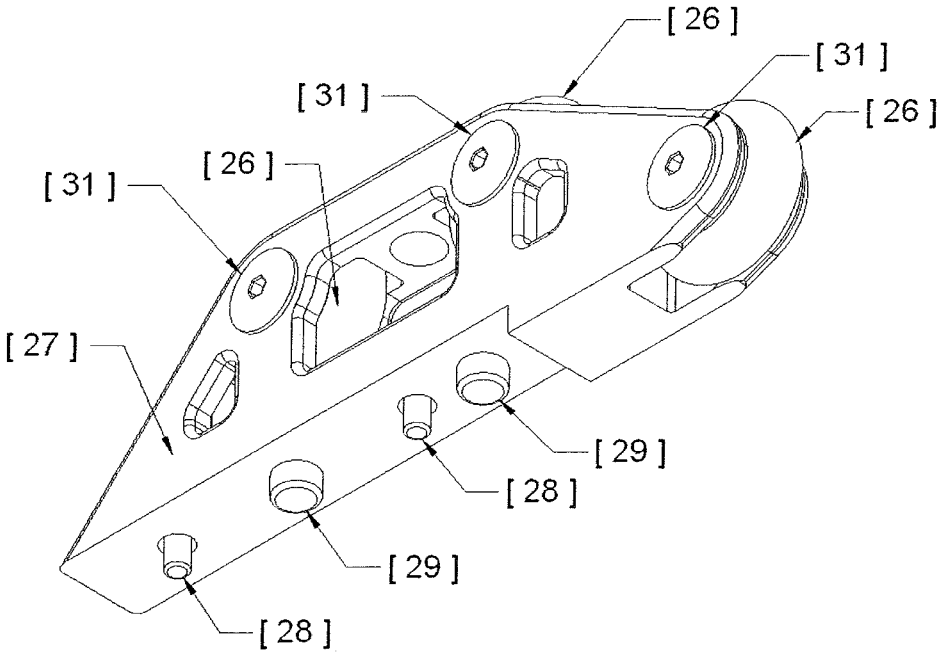
FIG. 5 illustrates an embodiment of an isometric view of one of the five wheeled sub-assemblies that makes up the roller nose.

FIG. 5 illustrates an isometric view of an embodiment of the underside of one of the five wheeled sub-assemblies that fits into the roller nose mandrel [20], as referenced in FIG. 4. It shows the wheel retainer [27], two metric cap head bolts [28], and two dowel pins [29] that fit snugly into the roller nose mandrel [20], see FIG. 4. Also shown are three independent wheels [26] that fit into machined slots in the wheel retainer [27]. Additionally, axle end retaining bolts [31], with Allen key holes, permit secure clamping of the axles in the wheel retainer [27]. The axle end retaining bolts [31] are drilled out to receive a round grease probe (not shown) that fills a cavity inside the axle and pushes grease around a system of channels to lubricate the wheels [26] before running the articulated wireline hole finder [1] in the borehole, as demonstrated in FIG. 2.

Figure 6:
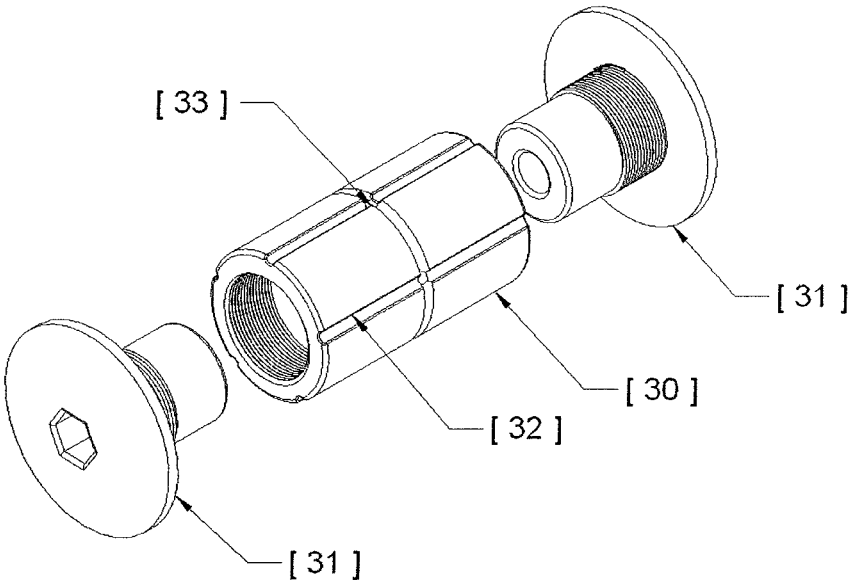
FIG. 6 illustrates an embodiment of an isometric view of a wheel axle, and axle end retaining bolts, for fixture in the wheel retainers; with the grease holes and channels for wheel lubrication, machined into the axle body.

FIG. 6 illustrates an isometric and exploded view of an embodiment of one of the wheel axles [30]. The axle [30] has internal female threads at both ends, into which the axle end retaining bolts [31] fit, clamping securely the axle [30] to the wheel retainer [27], as referenced in FIG. 5. Each axle [30] has four radial holes [33] that connect the external surface of the axle to the interior cavity. Four machined channels [32] along the length of the axle [30] help the distribution of grease against the wheel [26] and wheel retainer [27], as described in the preceding paragraph for FIG. 5. The axle end retaining bolts [31] are clamped with an Allen Key and possess a round bore to accept a grease probe (not shown).

Figure 7:
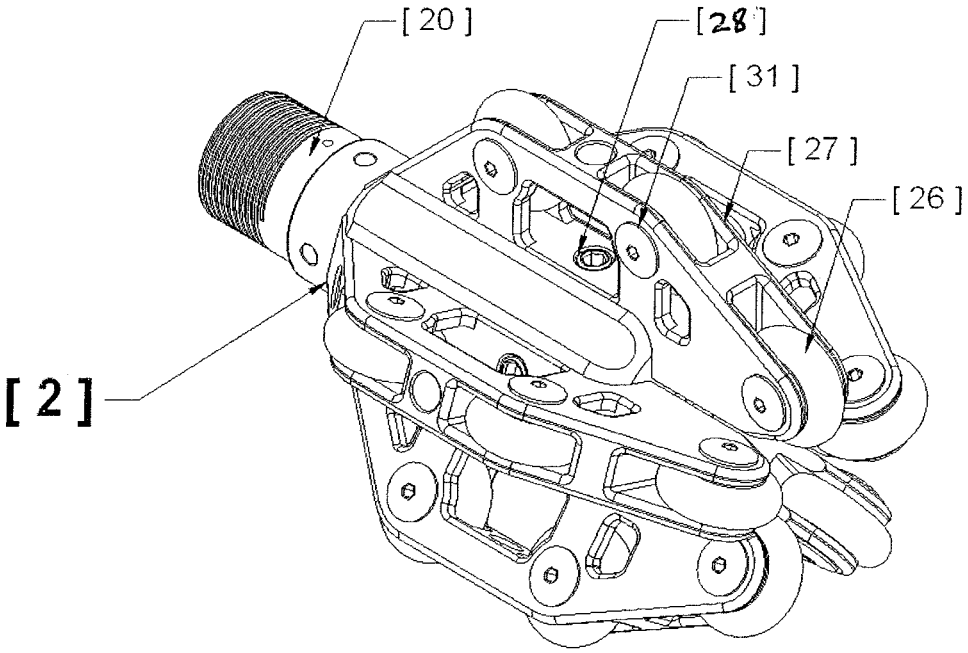
FIG. 7 illustrates an embodiment of an isometric view of the roller nose assembly, illustrating the five wheeled sub-assemblies fixed to the mandrel.
Figure 7A:
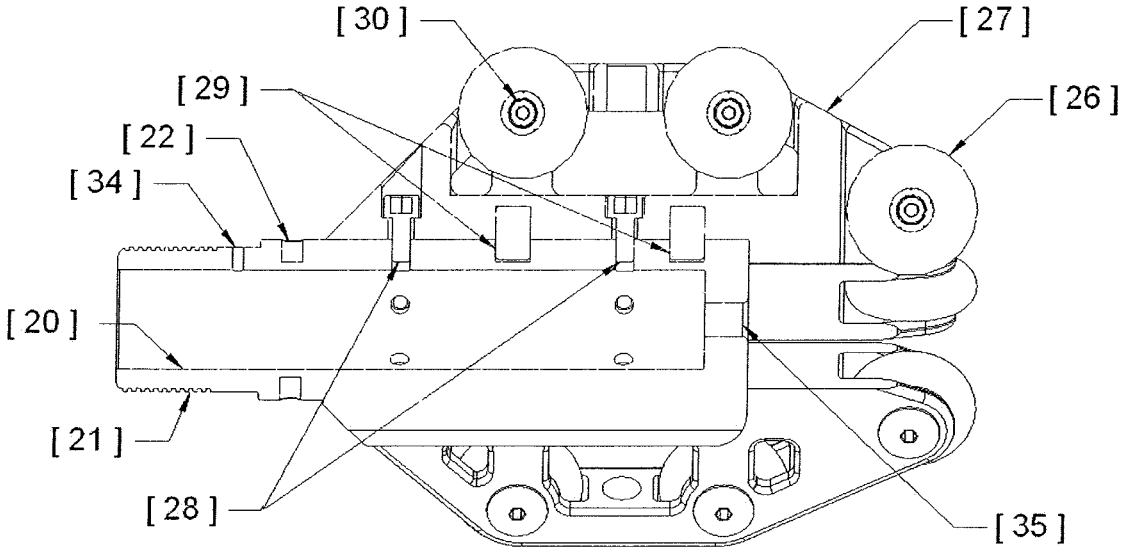

FIG. 7 illustrates an isometric view of an embodiment of the previously shown roller nose [2] in its entirety, comprising roller nose mandrel [20], wheel retainer [27], wheels [26], axle end retaining bolts [31] and M10 cap head bolts [28] which affix the wheeled sub-assemblies onto the roller nose mandrel [20]. The five sets of wheeled sub-assemblies are clearly visible, with an equal phasing of approximately and about seventy-two degrees around the central axis of the roller nose mandrel [20].

FIG. 7(*a*) illustrates a section view of an embodiment of the previously shown roller nose [2], comprising roller nose mandrel [20], wheel retainer [27], wheels [26], axles [30], and M10 cap head bolts [28] which affix the wheel retainers [27] onto the mandrel [20]. The two dowel pins [29] resist any shear forces on the M10 cap head bolts [28] and the cavity on the inside of the mandrel terminates with a central bleed port [35] which allows wellbore fluid to drain from the roller nose [2] and spacer sub [3] once returned to surface, the configuration of which is shown in FIG. 1. The pilot thread [34] shows where the button socket head screw (not shown) is fitted to stop the spacer sub [3] from unscrewing from the roller nose mandrel [20] and the holes [22] for the C spanner (not shown) to tighten the roller nose mandrel [20] into the spacer sub [3].

Figure 8:
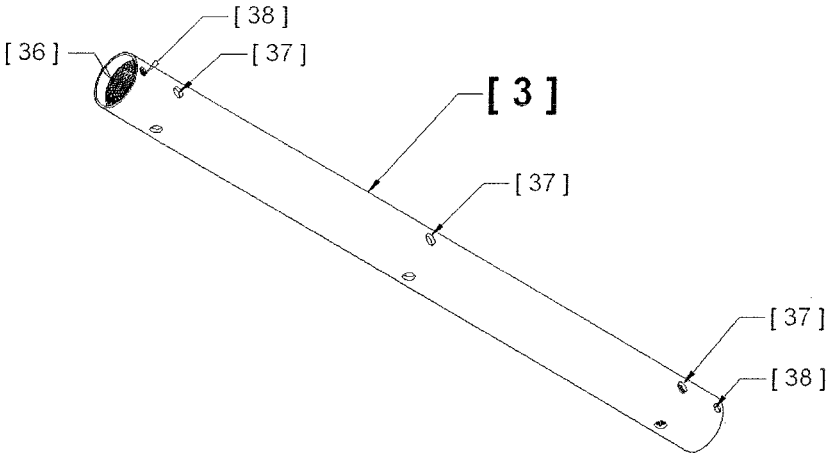
FIG. 8 illustrates an embodiment of the spacer sub that connects the roller nose to the articulated spring joint, with female threaded connections, fluid entry and exit ports, and pilot hole for a button socket head screw.

FIG. 8 illustrates an isometric view of an embodiment of the spacer sub [3] in its entirety, comprising female stub acme threads [36] at either end which allow fitment onto the roller nose [2] at the bottom and the articulated spring joint [4] at the top, the configuration of which was displayed in FIG. 1. Also shown are a series of fluid entry and exit ports [37] in the spacer sub [3] and pilot holes [38] for the button socket head screws (not shown) which stop the spacer sub [3] from unscrewing from its adjacent parts in the assembly.

Figure 9:
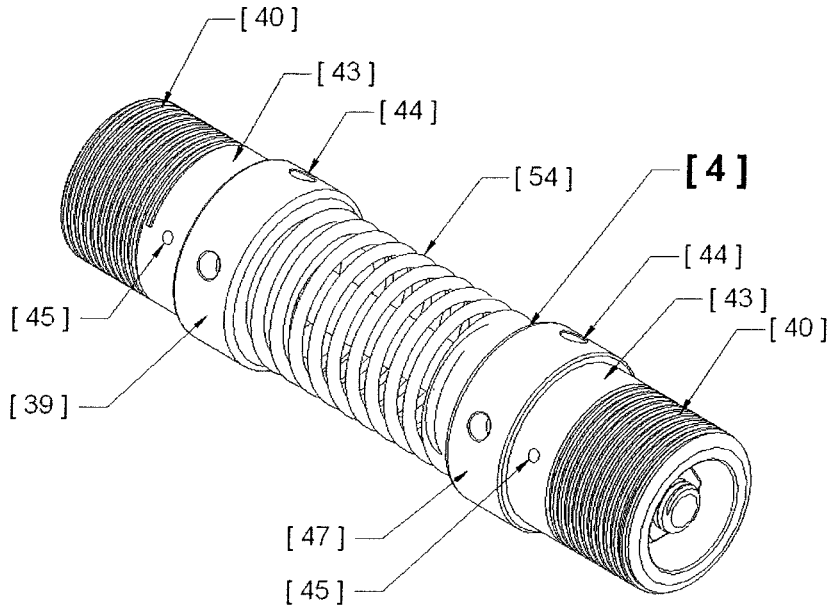
FIG. 9 illustrates an embodiment of an isometric view of the articulated spring joint.
Figure 9A:
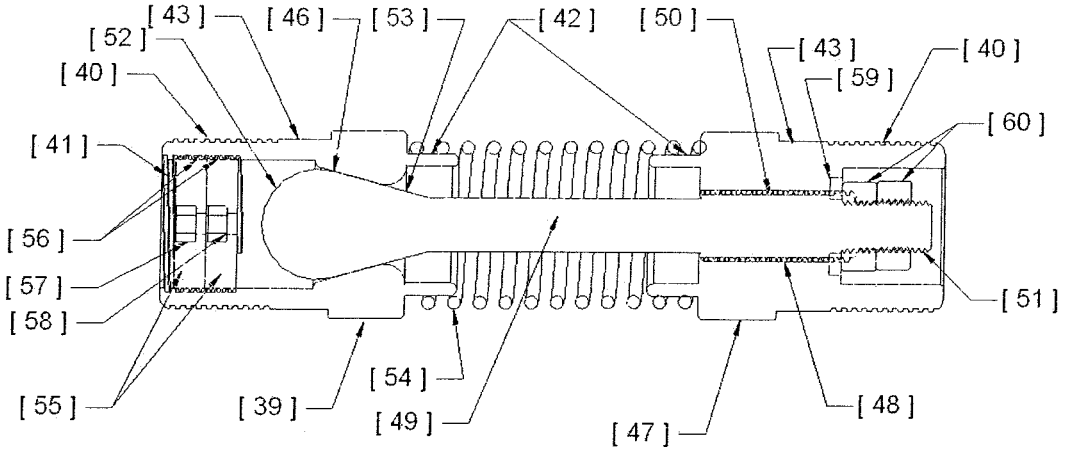

FIG. 9 shows an isometric view of an embodiment of the articulated spring joint [4] in its entirety, with two male stub acme threads [40] at either end which allow fitment to the spacer sub [3] at the bottom and main body [5] at the top, the configuration of which was displayed in FIG. 1. The flanges [43] and pilot threads [45] for connection to the main body [5] and spacer sub [3] are also shown. The spring [54] applies a compressional force between the upper and lower halves of the articulated spring joint [4], keeping the assembly stiff and impeding any articulation. C Spanner holes [44] for the C spanner (not shown) allow tightening to adjacent parts of the articulated wireline hole finder assembly.

FIG. 9(*a*) shows a section view of an embodiment of the previously shown articulated spring joint [4]. At the center of the assembly is a main pin [49] which is connected to the lower half [47] of the articulated spring joint [4] via an internal stub acme thread; male [50] and female respectively [48]. The main pin [49] is locked into the lower half [47] of the articulated spring joint [4] with a washer [59] and two M20 nuts [60], which screw onto a male M20 thread [51] on the lower end of the main pin [49]. The upper end of the main pin [49] is not permanently fixed in the upper half [39] of the articulated spring joint [4]. It possesses a tapered ball joint [53] which positively locates in a female tapered flange [46], held in its default locked position by a spring [54]. The spring [54] pushes the two articulated spring joint halves [39] and [47] apart, thereby pulling the tapered ball joint [53] into the female tapered flange [46]. Upon compression of the spring [54] the main pin [49] unseats itself from the female tapered flange [46] and allows articulation of up to about 12 degrees from the central axis of the articulated spring joint [4]. The upper end of the main pin [52] is hemispherical, and its axial motion is limited by the twin blanking plugs [55] which are positively located in the upper half of the spring joint [39] via a stub acme thread [56]. In both conditions, with the articulated spring joint [4] actuated or locked straight, the spring [54] is held in alignment with the upper and lower halves [39] and [47] respectively, by external spring flanges [42]. When the spring compression is relieved the tapered ball joint [53] pushes back into the female tapered flange [46] and the articulated spring joint [4] is locked in its default position.

Figure 10:
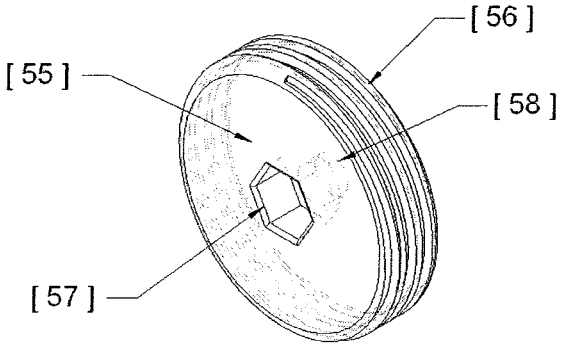
FIG. 10 illustrates an embodiment of an isometric view, including hidden lines, of the blanking plug which is utilized in the upper half of the articulated spring joint, to limit the axial movement of the main pin when activated.

FIG. 10 shows an isometric view of an embodiment of the blanking plug [55] with exterior stub acme thread [56]. The Allen key hole [57] is used to tighten the blanking plug [55] into the upper half of the previously shown articulated spring joint [4]. Through the center of the blanking plug [57] is a fluid entry port [58] which allows wellbore fluid to equalize inside the upper half of the articulated spring joint [4]. Note that the arrow highlighting the fluid entry port [58] is directed at a hidden line in the sketch.

Figure 11:
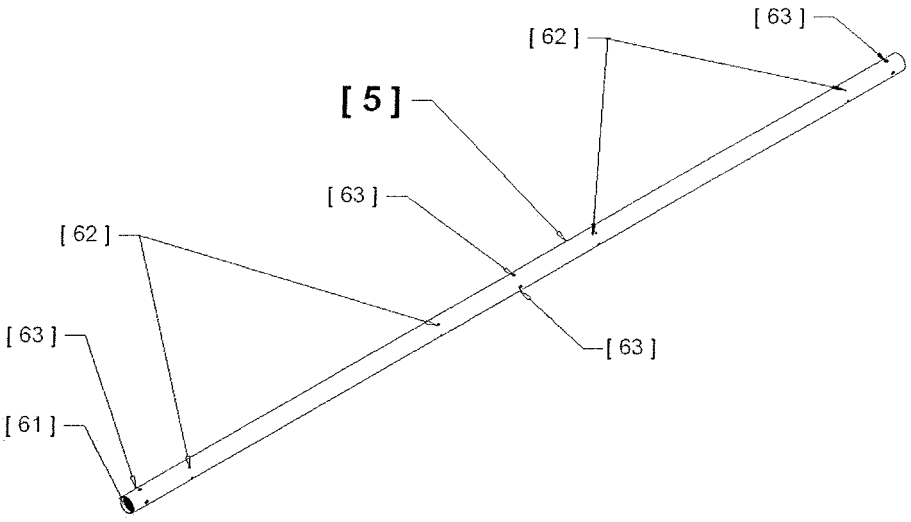
FIG. 11 illustrates an embodiment of the main body of the hole finder, which holds the centralizers, and is connected between the articulated spring joint upper connection and the crossover to the wireline logging string; showing the female threaded connections, the fluid entry and exit ports, and the mounting holes for the centralizer lock rings.

FIG. 11 shows an isometric view of an embodiment of the main body [5] in its entirety, comprising female stub acme threads [61] at either end which allow fitment onto the articulated spring joint [4] at the bottom and the crossover [8] at the top, as illustrated by FIG. 1. Also shown are a series of fluid entry and exit ports in the main body [63] and five mounting holes [62] phased at approximately and about seventy-two degrees for the centralizer lock rings, discussed in FIG. 13.

Figure 12:
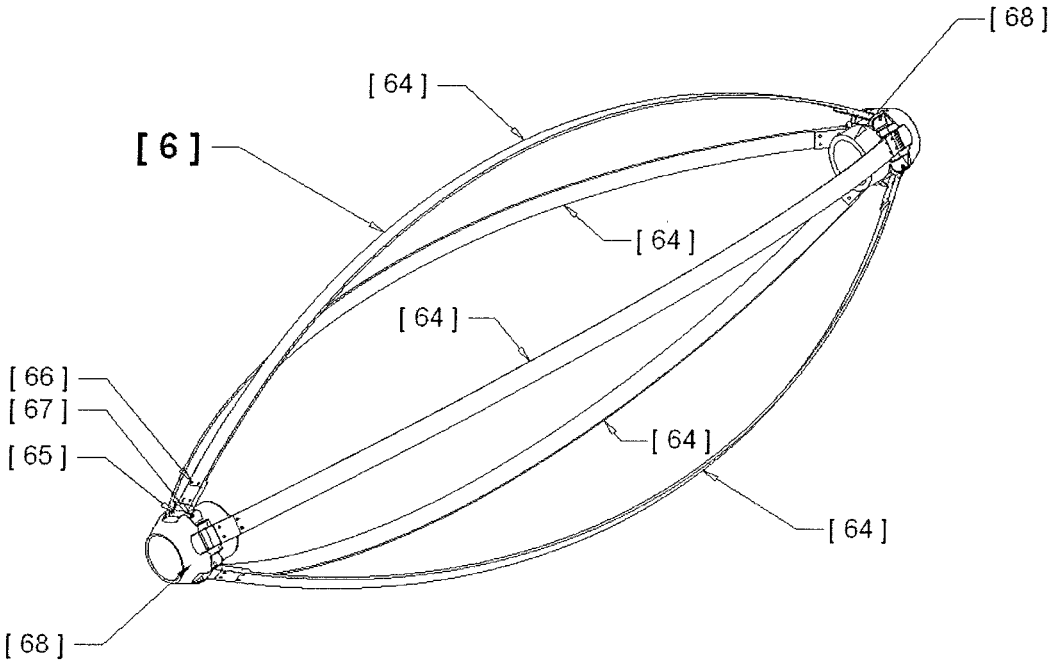
FIG. 12 illustrates an embodiment of a centralizer with five leaf spring arms and sliding end mounts which allow movement over the main body when the centralizer is compressed or expanded.

FIG. 12 shows an isometric view of an embodiment of a centralizer [6] in its entirety, comprising five leaf spring arms [64], which are connected to pivoting arm connectors [65] by four rivets [66]. The pivoting arm connectors [65] are fixed with a retaining pin [67] into the centralizer floating ends [68]. The centralizer floating ends [68] are mounted on the main body with sufficient clearance to allow axial and radial movements when the centralizers [6] expand, contract, and rotate.

Figure 12A:
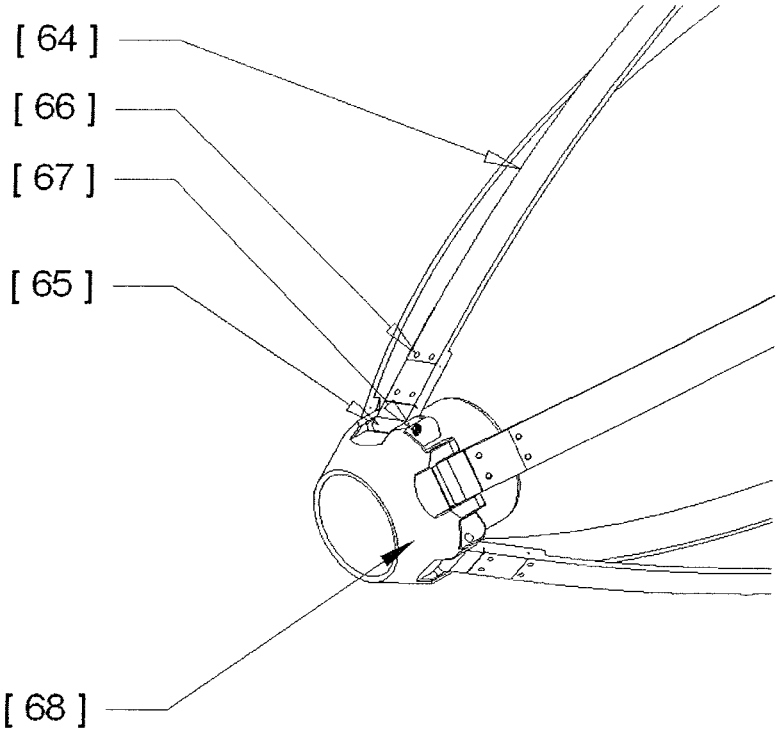

FIG. 12*a* shows an isometric view of one end of an embodiment of the previously shown centralizer [6] to illustrate the centralizer floating ends [68]. The leaf spring arm [64] is affixed to the pivoting arm connectors [65] by four rivets [66]. The pivoting arm connectors [65] are fixed with a retaining pin [67] into the centralizer floating end [68].

Figure 13:
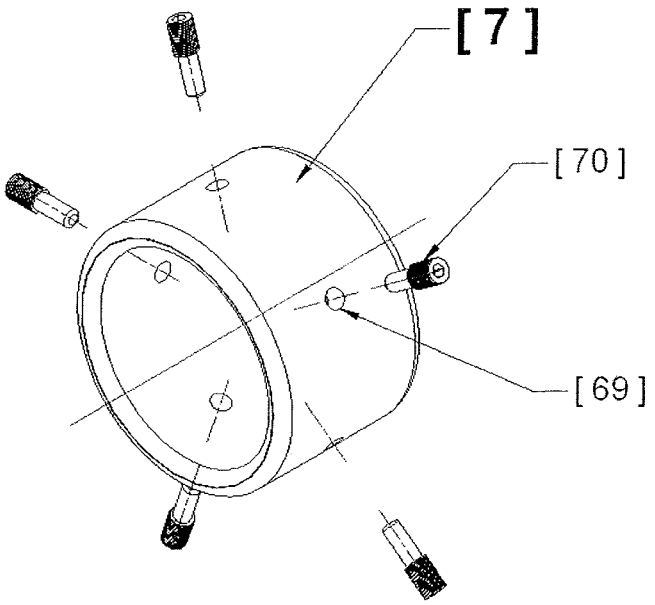
FIG. 13 illustrates an embodiment of the centralizer lock rings which are affixed to the main body with five grub screws to limit the axial movement of the centralizers.

FIG. 13 shows an isometric view of one embodiment of the centralizer lock ring [7] in its entirety. The purpose of the centralizer lock ring [7] is to be fixed to the previously shown main body [5] to limit the slide of the centralizer floating ends [68] when the leaf spring arms [64] compress or expand with the borehole geometry, as illustrated in FIG. 12. For a single centralizer lock ring [7] the five partially threaded grub screws [70] screw into the female threads [69] and are pre-aligned with the five holes [62] in the main body [5], as illustrated in FIG. 11. Each centralizer has two centralizer lock rings [7] mounted on the main body [5] to limit the movement of the centralizer floating ends [68] in both up and down directions, as illustrated in FIG. 12.

Figure 14:
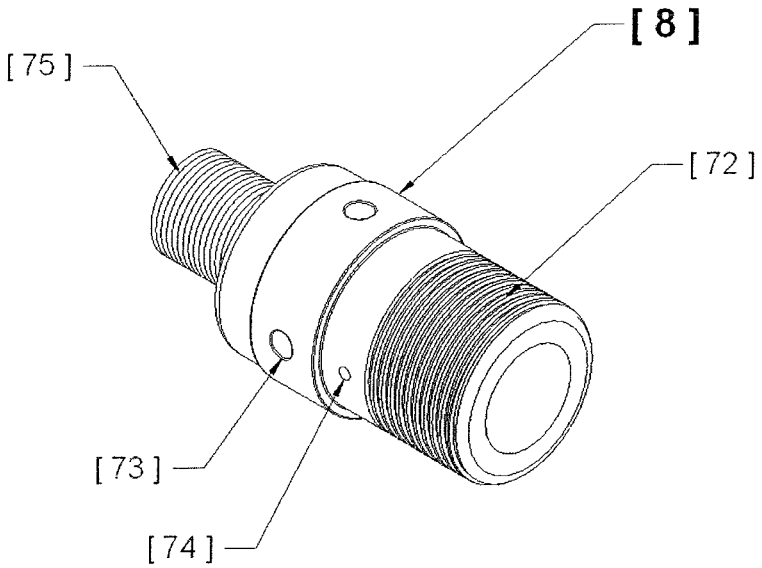
FIG. 14 illustrates an embodiment of the crossover, illustrating the male threaded connections for the main body and the bottom of the wireline tool-string.

FIG. 14 shows an isometric view of the crossover [8] which fits between the upper end of the main body [5] and the wireline tool-string [15], as illustrated in FIG. 1. A male stub acme thread [72] is shown on the lower end of the crossover and an opposing male thread [75] to the logging tool-string connection is shown on the upper end. Four opposing holes [73] for the 'C' spanner (not shown) to aid tightening are shown, along with the threaded pilot hole for the button socket head screw (not shown) to ensure the crossover [7] cannot unscrew from the main body [5], the configuration of which was illustrated in FIG. 1.

What is claimed is:

1. An articulated wireline hole finder, comprising:

a low-friction roller nose, wherein the low-friction roller nose comprises:

a central mandrel, wherein the central mandrel further comprises at least one slot located on an outer surface of the central mandrel; and at least one sub-assembly, wherein the at least one sub-assembly attaches to the central mandrel through the at least one slot and wherein the at least one sub-assembly comprises at least one wheel, wherein each of the at least one wheel are mounted in profiled wheel retainers that bolt onto the central mandrel; and an articulated spring joint, wherein the articulated spring joint connects to the low-friction roller nose through a sub spacer.

2. The articulated wireline hole finder of claim 1, including a plurality of said slots located on the mandrel and a plurality of sub-assemblies attached to the central mandrel through the plurality of slots, each sub-assembly including three wheels and a plurality of axles.

3. The articulated wireline hole finder of claim 2, wherein the plurality of axles comprises a grease port and a plurality of grease channels.

4. The articulated wireline hole finder of claim 1, wherein the at least one sub assembly bolts onto the central mandrel.

5. The articulated wireline hole finder of claim 1, wherein the articulated spring joint is axially spaced uphole from the mandrel.

6. The articulated wireline hole finder of claim 1, further comprising a main body and a centralizer, wherein the centralizer connects to the main body and further comprises at least one leaf spring arm and the at least one leaf spring arm connects to a floating end at both ends of the at least one leaf spring arm.

7. The articulated wireline hole finder of claim 6, wherein the floating end connects to the at least one leaf spring arm by a pivoting arm connector through a retaining pin.

8. The articulated wireline hole finder of claim 7, wherein the floating end allows the centralizer to revolve around the main body and a pivoting arm allows the centralizer to flex.

9. The articulated wireline hole finder of claim 6, wherein at least one lock ring prevents the centralizer from compressing along the axis of the main body.

10. The articulated wireline hole finder of claim 9, wherein the centralizers have a maximum opening diameter of about thirty inches and a minimum compressed diameter of about less than six inches.

11. The articulated wireline hole finder of claim 1, wherein the articulated spring joint initiates a pivoting action and moves the low-friction roller nose.

12. The articulated wireline hole finder of claim 1, wherein the articulated spring joint comprises two halves, connected by a main pin and a spring which is under compression.

13. The articulated wireline hole finder of claim 12, wherein the main pin comprises a tapered ball joint at one end and is threaded at the opposing end.

14. The articulated wireline hole finder of claim 12, wherein the spring is smaller in diameter than the external diameter of a body of the articulated wireline hole finder.

15. The articulated wireline hole finder of claim 1, wherein the articulated spring joint comprises articulation that is about approximately twelve degrees from a central axis of the articulated wireline holder finder when fully actuated.

16. The articulated wireline hole finder of claim 15, wherein the articulated spring joint is pressure compensated with a fluid entry port and a fluid exit port.

17. The articulated wireline hole finder of claim 16, wherein a blanking plug equalizes the fluid at the fluid entry port.

18. The articulated wireline hole finder of claim 1, wherein a main body length is adjustable.

19. The articulated wireline hole finder of claim 1, further comprising a main body, wherein the main body further comprises a tube and a centralizer, wherein the centralizer further comprises at least one leaf spring arm.

* * * * *